US005404955A

United States Patent [19]

Echols, III et al.

[11] Patent Number: 5,404,955

[45] Date of Patent: Apr. 11, 1995

[54] RELEASABLE RUNNING TOOL FOR SETTING WELL TOOL

[75] Inventors: Ralph H. Echols, III; Dhirajlal C. Patel, both of Carrollton; Tommy F. Grigsby, Plano, all of Tex.

[73] Assignee: Halliburton Company, Houston, Tex.

[21] Appl. No.: 101,713

[22] Filed: Aug. 2, 1993

[51] Int. Cl.[6] ..... E21B 23/00

[52] U.S. Cl. ..... 166/382; 166/383; 166/386; 166/122; 166/237

[58] Field of Search ..... 166/120, 301, 381, 382; 175/321, 322, 325.3

[56] References Cited

U.S. PATENT DOCUMENTS

| | | | |
|---|---|---|---|
| 4,078,606 | 3/1978 | Montgomery | 166/120 |
| 4,270,620 | 6/1981 | Lawrence | 175/65 X |
| 4,562,889 | 1/1986 | Braddick | 166/381 |
| 4,942,924 | 7/1990 | Duncan | 166/290 |
| 4,942,925 | 7/1990 | Themig | 166/382 |
| 5,018,583 | 5/1991 | Baker | 166/382 |
| 5,224,547 | 7/1993 | Burns, Sr. et al. | 166/98 X |

*Primary Examiner*—Ramon S. Britts
*Assistant Examiner*—Frank S. Tsay
*Attorney, Agent, or Firm*—Tracy W. Druce; Drude Faulconer

[57] ABSTRACT

A well tool assembly and a method of operating same including a clutch which provides a rotary-driving connection between a running tool and well tool mandrel when the running tool is rotated in a first direction (e.g. clockwise) and has cammed surfaces which ride up on complementary cammed surfaces on the mandrel to disengage the clutch when the running tool is rotated in a second (e.g. counterclockwise) or opposite direction. Once the clutch is disengaged, the running tool can be disconnected from the mandrel by rotating the running tool in said first direction. The clutch can be disengaged either hydraulically at the same time a well tool (e.g. a packer) is being hydraulically set or by rotation of the running tool in the second direction in the event the well tool assembly becomes stuck before the assembly reaches its destination.

32 Claims, 5 Drawing Sheets

40
47
48
62
41
35
42
61
73
34
33
11
62a
29
15
32
31
30
74
17

40
47
41
48
42
61
35
62A
33
11
29
32
31
15
17

RELEASABLE RUNNING TOOL FOR SETTING WELL TOOL

DESCRIPTION

1. Technical Field

The present invention relates to well tool assemblies and in one of its aspects relates to a well tool assembly and a method of operation wherein a running tool can be disconnected from a well tool mandrel by first disengaging a clutch which normally provides a driving connection therebetween and then rotating the running tool to disconnect it from the well tool mandrel.

2. Background

In completing production or injection wells, it is common practice to run various well tools (e.g. packers) into the wellbore in a retracted position and then expand or "set" the well tool once the tool has reached its destination. For example, it is common to run a well tool (e.g. packer) as part of a well screen assembly of the type used in a typical gravel pack completion. The well tool assembly normally is run into the wellbore on some type of running tool which, in turn, is releasably connected to the lower end of a tubing string. After the well screen is positioned adjacent a producing formation and gravel is pumped down to fill the well annulus around the screen, the running tool is then manipulated to set the packer to isolate the gravel-packed interval from the upper wellbore. The running tool is then released from the well tool assembly and is withdrawn from the wellbore along with the tubing string.

As will be recognized by those skilled in the art, there are a multitude of well tool assemblies of the general type described above which are capable of not only carrying out the desired operation but also of being released from the well tool assembly so the running tool and the tubing string can be removed from the well after the operation has been completed. Many of these assemblies rely on slotted or threaded connections to couple the well tool to the running tool during the running and setting of the well tool. Such assemblies have used shearable elements (e.g. shear pins) to protect against premature disconnection of the running tool from the well tool when the running tool is rotated in a direction which would normally disconnect the running tool from the well tool. Further, shear pins may also be used in these assemblies to provide weight supporting functions and for controlling the setting sequence for the packer.

Unfortunately, such pins frequently undergo substantial wear before the well tool assembly reaches it destination which can result in the premature shearing of the pins and hence, the premature setting of the packer and/or the disconnection of the running tool from the well tool. This possibility is especially present in the modern, long and heavy well tool assemblies required for completing extremely thick production intervals and in those well tool assemblies required to complete production intervals in horizontal or inclined wellbores where the forces exerted on any shear pins in the well tool assembly during installation can be substantial.

One proposed solution for preventing the premature shearing of the shear pins in a well tool assembly is to merely include additional or stronger shear pins. However, as may be expected, for a shear pin(s) to be strong enough to prevent premature shearing in some tool assembles, the force required to deliberately shear that pin(s) may be more than can be developed through the tubing string on which the assembly is carried.

Further, there may instances where the well tool assembly becomes stuck in the wellbore before it reaches its destination. When this occurs, it is highly desirable to be able to release the running tool and recover it along with the tubing string from the wellbore without the need for first setting the well tool.

Accordingly, especially where heavy or strong well tool assemblies must be run and set in verical, horizontal, and/or inclined wellbores, a need exists for well tool assemblies which include a running tool which can set the well tool and then be easily released for recovery from the wellbore. Further, the running tool should also have the capability of being released anytime the well tool assembly becomes stuck in the wellbore so that the running tool and tubing string can be recovered from the well.

SUMMARY OF THE INVENTION

The present invention provides a well tool assembly and a method of operating same which is comprised of tubular member (e.g. well tool mandrel) which carries a well tool (e.g. packer) which is hydraulically manipulable to an operable position when the well tool assembly reaches it destination within a wellbore. The body of a running tool is connected to the lower end of a workstring (e.g. tubing string) for rotation therewith and is coaxially aligned with and is releasably connected to the mandrel.

A clutch provides a rotary-driving connection between the running tool and the mandrel when the running tool is rotated in a first direction (e.g. clockwise) and has cammed surfaces which ride up on complementary cammed surfaces on the mandrel to disengage the clutch when the running tool is rotated in the opposite direction. Once the clutch is disengaged, the running tool can be disconnected from the mandrel by rotating the running in said first direction. The reverse rotation feature of the present invention to disengage the clutch permits the disconnection and recovery of the running tool in the event the well tool assembly becomes stuck before the assembly reaches its destination and the packer is set.

More specifically, the present invention is comprised of a tubular mandrel which carries a packer which is set by a first hydraulically-actuated piston. A running tool having a body is coaxially aligned with and is releasably connected to the mandrel by "left-handed" threads. All other threads in the well tool assembly are "right-handed" threads whereby none of the other components in the well tool assembly or tubing string will be loosen by right-hand or clockwise rotation of the tubing string. A sleeve valve is slidably mounted in the bore of the body of the running tool and is movable between a normally closed position to an open position. A ball catcher is slidably mounted within the sleeve and is held in position by a shear pin or the like.

A clutch is slidably mounted on the body of the running tool and is initially held in an engaged position by a shearable element. The clutch provides a driving connection between lugs on the mandrel and lugs on the body of the running tool to rotate the mandrel whenever the tubing string is rotated. This prevents the right-handed rotation from loosening and unthreading the left-handed threads which connect the running tool to the mandrel. The clutch also has cammed surfaces which cooperate with complementary cammed surfaces on the mandrel to move the clutch upward to a disengaged position when the running tool is rotated in a left-handed direction. A detent latches and holds the clutch in its disengaged position so that once the clutch is disengage, right-handed rotation of the running tool will unthread the running tool from the mandrel.

When the tool assembly reaches its destination, a ball is dropped or pumped down the tubing string until it contacts the ball catcher. Increased pressure on the fluid in the tubing string forces the valve sleeve to its open position whereupon fluid acts on the first piston to set the packer. At the same time, the fluid also acts on a second hydraulically-actuated piston in the tool assembly to engage and move the clutch upward to its disengaged position where it is latched to permit relative rotation of the body and the mandrel when the running tool is rotated in a right-handed direction to thereby disconnect the running tool from the mandrel. The pressure in the tubing string is further increased to move the ball catcher downward to a position where the ball is free to pass through the catcher.

BRIEF DESCRIPTION OF THE DRAWINGS

The actual construction, operation, and apparent advantages of the present invention will be better understood by referring to the drawings in which like numerals identify like parts and in which.

DESCRIPTION OF THE PREFERRED EMBODIMENTS

Figure 1:
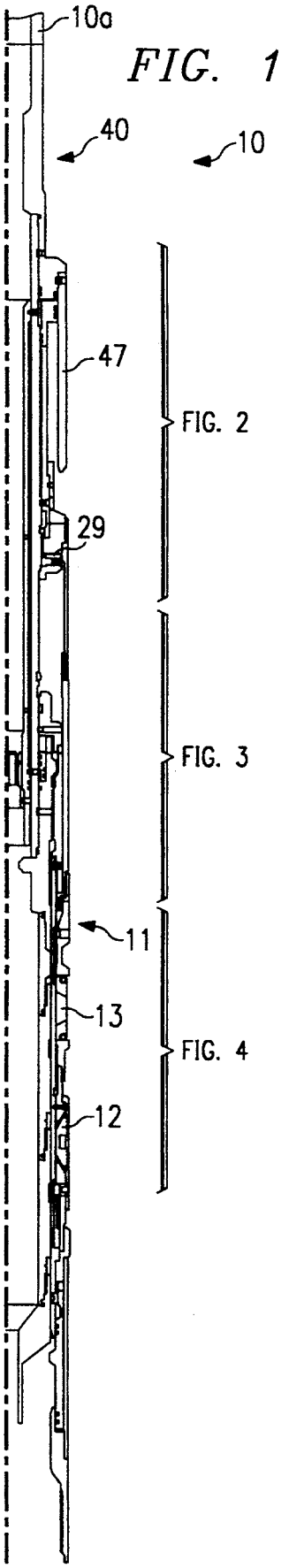
FIG. 1 is a longitudinal view, in half-section, of the entire well tool assembly of the present invention.
Figure 8:
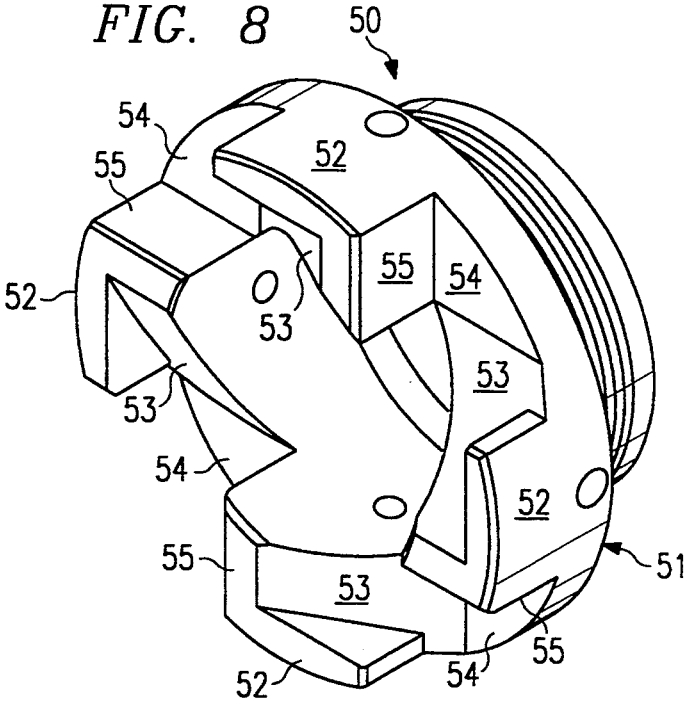
FIG. 8 is a perspective view of the clutch element of the present invention.
Figure 2A:
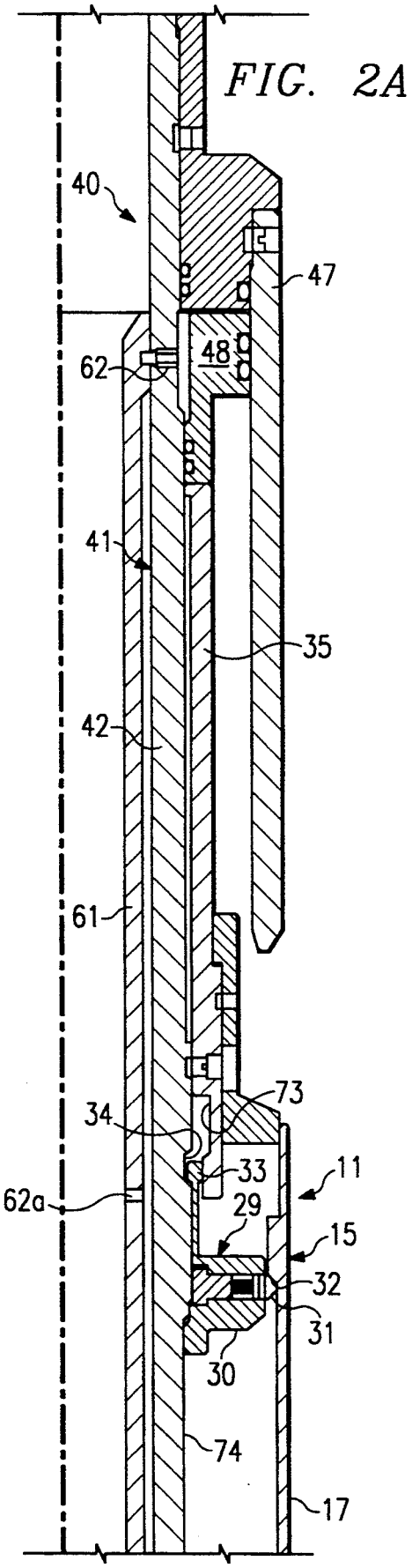
FIG. 2A is an enlarged view of portion "2" of the well tool assembly of FIG. 1 when in a running position.
Figure 2B:
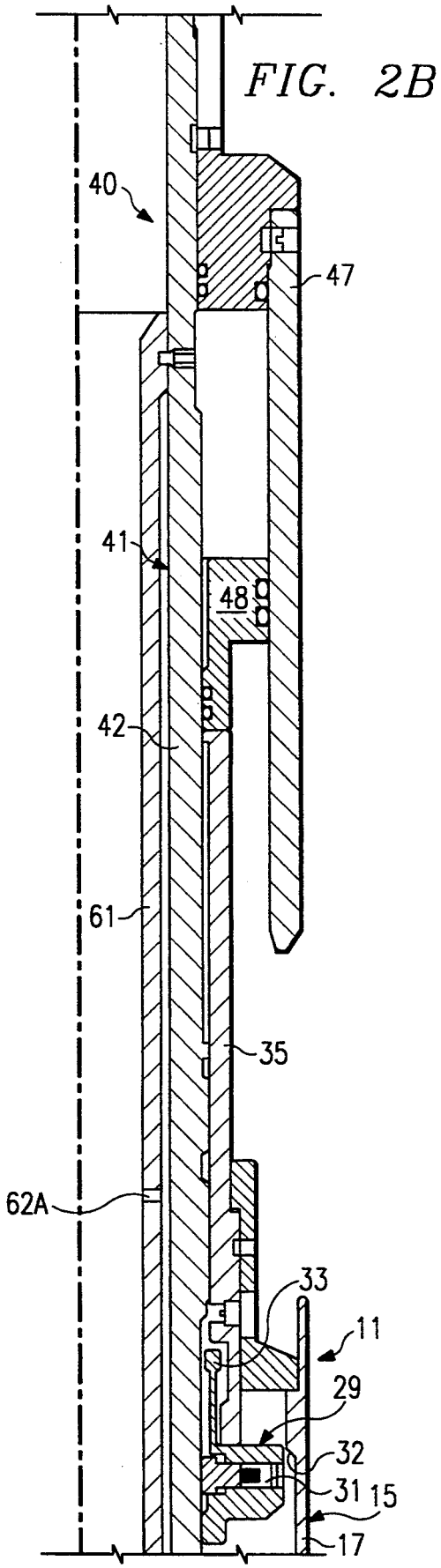
FIG. 2B is an enlarged view of portion "2" of the well tool assembly of FIG. 1 when in a set position.
Figure 3A:
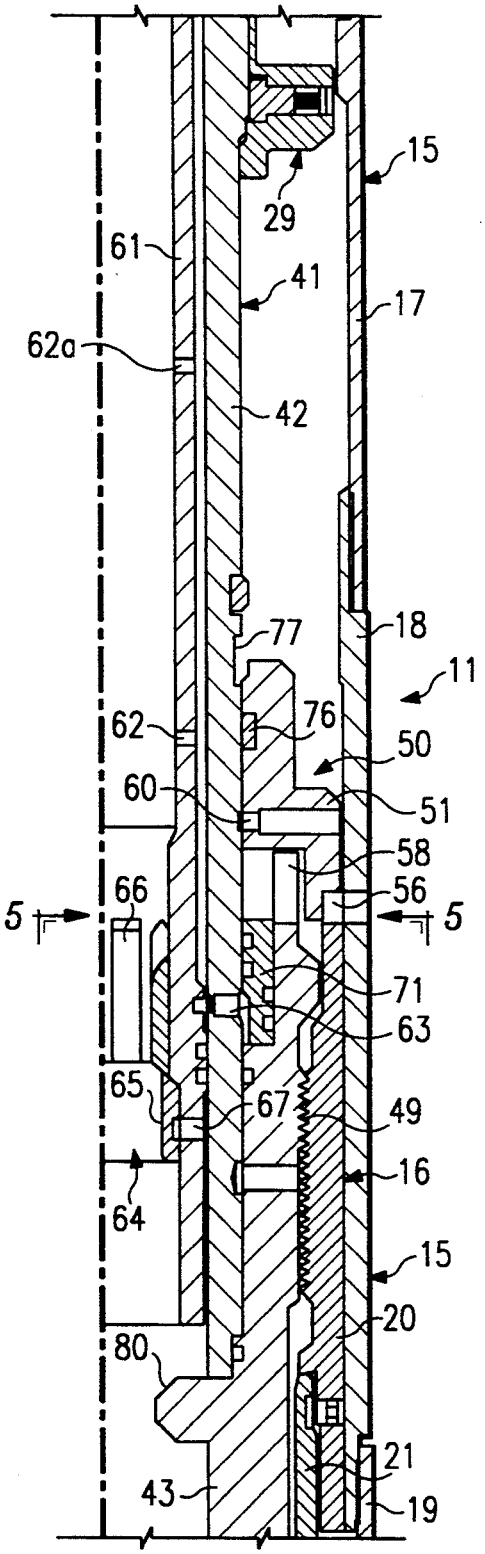
FIG. 3A is an enlarged view of portion "3" of the well tool assembly of FIG. 1 when in a running position.
Figure 3B:
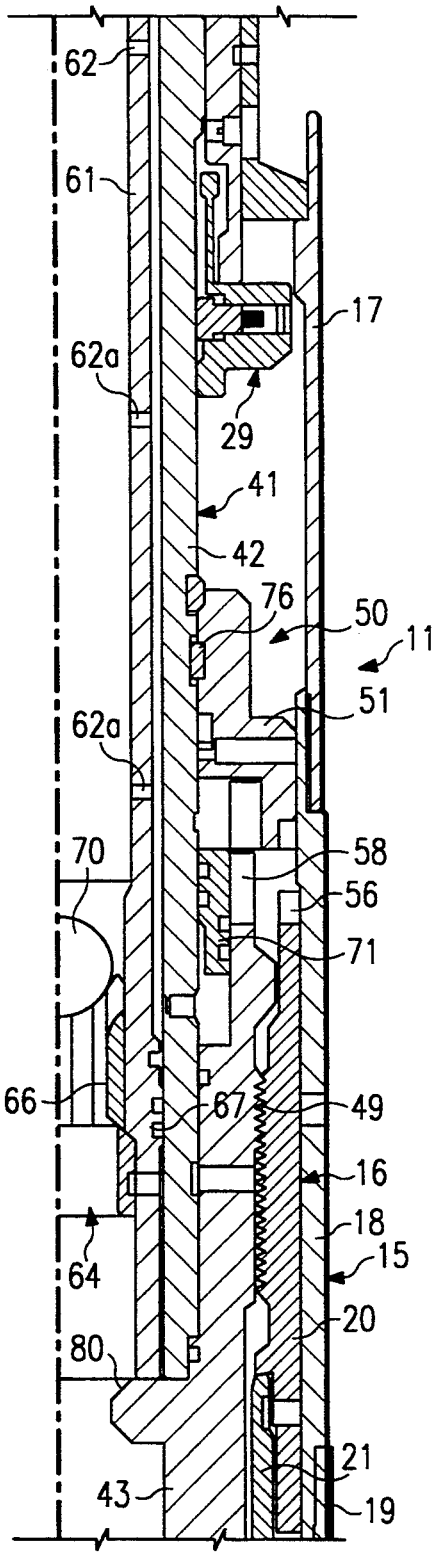
FIG. 3B is an enlarged view of portion "3" of the well tool assembly of FIG. 1 when in a set position.
Figure 4A:
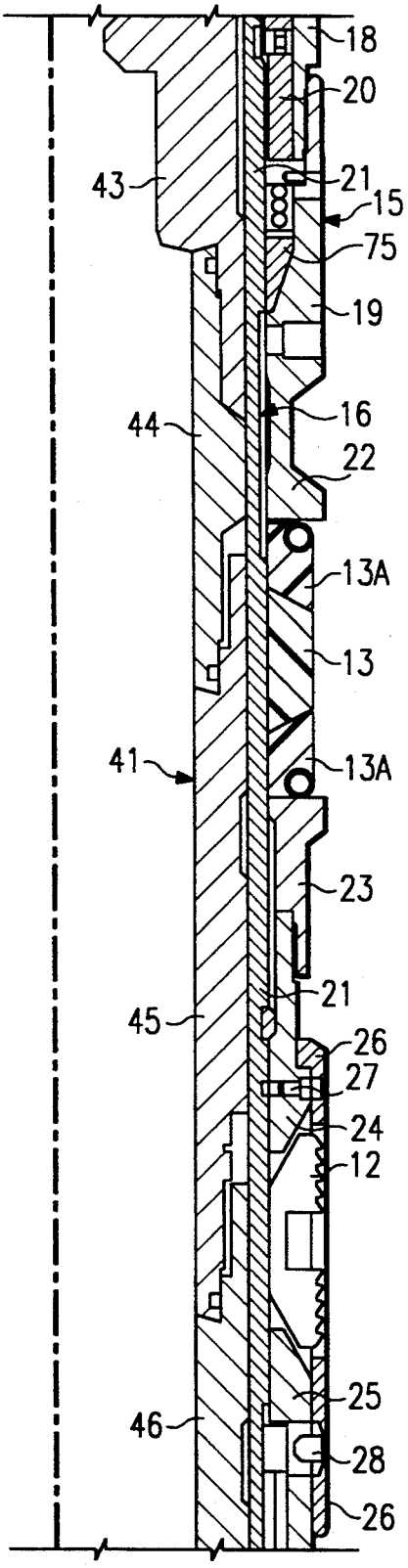
FIG. 4A is an enlarged view of portion "4" of the well tool assembly of FIG. 1 when in a running position.
Figure 4B:
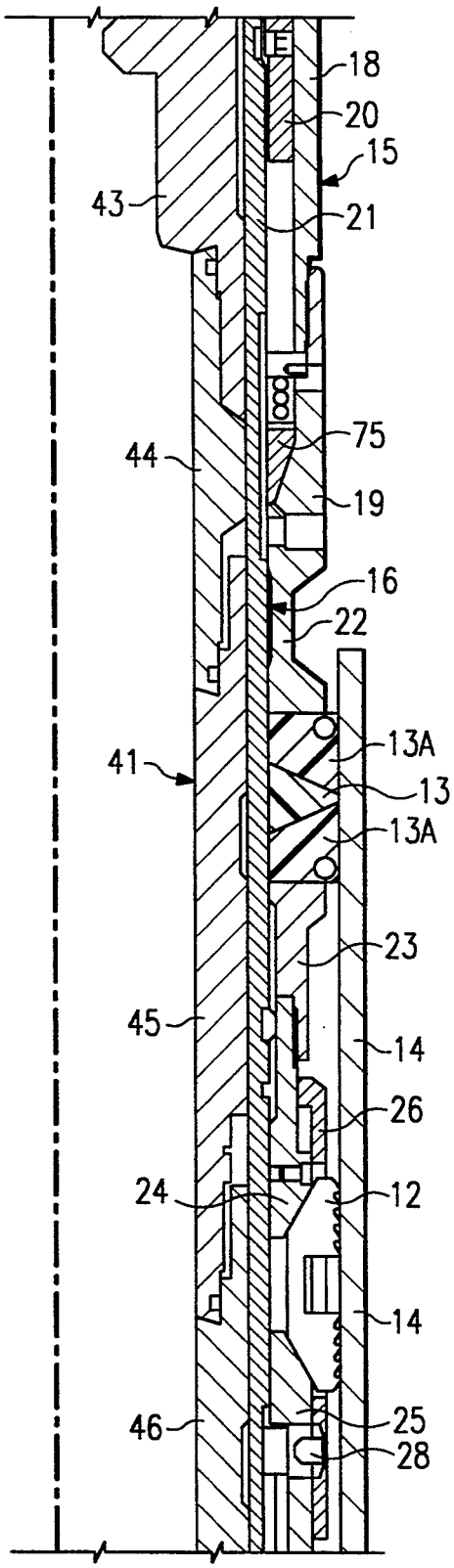
FIG. 4B is an enlarged view of portion "4" of the well tool assembly of FIG. 1 when in a set position.
Figure 5:
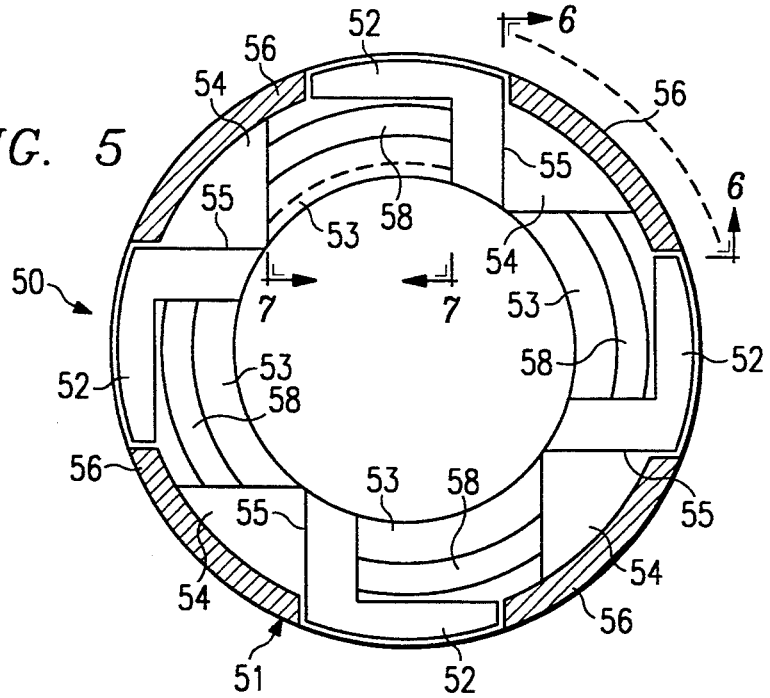
FIG. 5 is a sectional view taken along line 5—5 of FIG. 3A.
Figure 6:
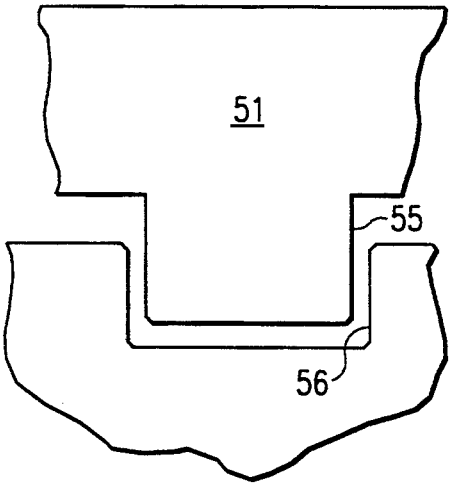
FIG. 6 is a sectional view taken along line 6—6 of FIG. 5.
Figure 7:
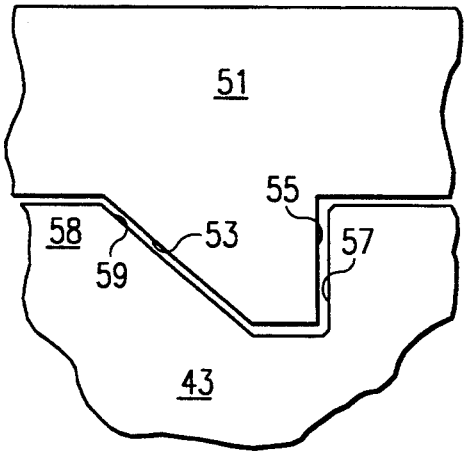
FIG. 7 is a sectional view taken along line 7—7 of FIG. 5.

Referring more particularly to the drawings, FIG. 1 discloses a half-section, taken along the longitudinal axis, of the well tool assembly 10 in accordance with the present invention. For purposes of better describing the present invention, the length of well tool assembly 10 of FIG. 1 has been separated into portions 2, 3, and 4; the details of which have been enlarged in FIGS. 2A and 2B, 3A and 3B, and 4A and 4B, respectively. To further aid in describing and understanding the invention, FIGS. 2A, 3A, and 4A disclose tool assembly 10 as its components appear when the tool is being run into a well while FIGS. 2B, 3B, and 4B show the tool after the components have been moved to their respective setting positions.

Tool assembly 10 is comprised of a tubular member, i.e. mandrel 11, which carries one or more work elements, e.g. slips 12 and packer 13, which are to be set within a well casing 14 (shown broken away in FIG. 4B) once the tool has been lowered to its operable position within the well. Mandrel 11, in turn, is comprised of two elements, i.e. outer element 15 and inner element 16 (FIGS. 3 and 4) which can move longitudinally in relation to each other in order to set the work elements when the tool 10 is in its operable position within a well.

Outer element 15 may be an integral member or, as illustrated, may be comprised of segments 17, 18, and 19 which are threaded or otherwise connected together. Inner element 16 may also be an integral member or, as illustrated, may be comprised of segments 20, 21 which are threaded or otherwise secured together. Although not shown in the drawings, the lower end of inner element 16 is adapted to be connected to a standard-type well completion component, e.g. a slotted screen or the like which forms part of a typical gravel-pack completion.

In such completions, the slotted liner (not shown) is lowered onto the bottom of the wellbore or is suspended from a liner hanger within casing 14 and gravel (not shown) is flowed around the liner as will be understood by those skilled in the art. Packer 13 is then set, as will be described in detail below, to block flow through the annulus above the liner to complete the gravel-pack operation. As used herein, "upper", "lower", "bottom", etc. are intended to be relative terms since the present invention can be used in horizontal or inclined wellbores as well as in vertical wellbores. Accordingly, "upper" refers to the end of the tool assembly which is nearest to the wellhead.

Packer 13, 13*a* is positioned between blocks 22, 23, each of which has a tapered surface adjacent the packer for expanding the packer when moved towards each other. Slips 12 are positioned between wedges 24, 25 which, in turn, are held on the the tool by retainer 26, which, in turn, is bolted or otherwise secured to the inner element 16 by shear bolt(s) 27, regular bolt(s) 28 or the like.

Longitudinal movement between inner element 16 and outer element 15 is prevented during the lowering of the tool assembly 10 by releaseable latch 29 (FIGS. 2 and 3). Latch 29 is comprised of a housing 30 having a spring-biased detent 31 mounted therein. The outer end of detent 31 engages shoulder 32 on segment 17 of outer member 15 to prevent member 15 from moving downward relative thereto. Detent 31 is normally biased inwardly and but is held in a latched position by abutment against segment 42. Housing 30 has a plurality of collet-type fingers 33 (only one shown) which cooperate with groove 34 in running tool 40 to hold the latch 29 in place. Fingers 33 are held in groove 34 by the lower end of actuator sleeve 35.

Running tool 40 extends into and is releasably coupled thereto. As will be understood by those skilled in the art, a running tool of this type must be capable of lowering and setting the work elements in the well bore and then be removable to the surface. Also, it is highly desirable, that the running tool and the workstring on which it is being lowered can be released from the stuck well tool and removed from the hole in the event that the well tool assembly becomes stuck in the wellbore before it reaches its operable position. The running tool of the present invention has this capability.

Running tool 40 is comprised of an elongated cylindrical body 41 which is coaxially aligned with mandrel 11 and is attached to its upper end to tubing string 10a (FIG. 1). Body 41 can be an integral member or, for ease of manufacture and assembly, as illustrated may be comprised of segments 42, 43, 44, 45, and 46 which may be threaded or otherwise secured together. Cylindrical member 47 (FIG. 2) is secured to body 41 to provide a cylinder for annular piston 48 which, in turn, rests on actuator sleeve 35 for a purpose described below. Segment 43 of body 41 is threaded to inner element 16 of mandrel 11 by cooperating "left-handed" threads 49 (FIG. 3).

As will be understood in the art, normally all of the different components which make up a typical workstring and tool assembly have "right-handed" threads, i.e. the components have threads which will be threaded together or tighten upon right-handed (i.e. clockwise) rotation. This is necessary to prevent the unthreading of components during operation since almost all known workstrings are or may have to be rotated in a right-handed direction during make-up and/or lowering in a wellbore. Accordingly, any components having "left-handed" threads will inherently be unthreaded during this right-handed (clockwise) rotation.

Again, "left-handed" may be a relative term since it should be recognized that if left-handed threads were ever used to couple together the components of a workstring on which the present invention is used, then threads 49 would have to become "right-handed" threads. In other words, in the present invention, rotation of the workstring in the direction which normally tightens the threads of the workstring components will also have to unthread the threads 49 which couple the running tool 40 to the mandrel 11.

To prevent threads 49 from prematuring unthreading during any right-handed rotation which may occur during the lowering of well tool assembly 10, clutch 50 (FIG. 3) provides a driving connection between body 41 of running tool 40 and inner element 16 of mandrel 11 whenever the running tool 40 is rotated clockwise (i.e. right-handed). As best seen in FIGS. 5–8, clutch 50 is comprised of a specially-designed clutch element 51 having a plurality (four) radially spaced legs 52. Each leg 52 has an inner cammed surface 53 which tapers upwards from the bottom of the leg to a flatten inner surface 54 up inside the leg (see FIG. 8). The front of each leg provides a relative vertical driving surface 55 as will be explained below.

Clutch element 51 is slidably mounted onto segment 42 of body 41 of running tool 40 and is positioned whereby the outer radial portion of each driving surface 55 will engage a relative vertical surface of a respective "square" driving lug 56 (FIGS. 3, 5 and 6) which, in turn, are provided on the top of inner member 16 of mandrel 11. The inner radial portion of each driving surface 55 engages the vertical surface 57 of a respective "cammed" lug 58 on segment 43 of body 41 of running tool 40. Each lug 58 has a complementary cammed surface 59 which is substantially a mirror image of cammed surface 53 on clutch element 51, the function of which will be explained below.

Clutch element 51 is held in an engaged position by shear pin 60 or the like. However, the actual driving connection between the body 41 of running tool 40 and mandrel 11 is through clutch element 51 and not through shear pin 60. That is, when the running tool 40 is rotated in a clockwise or right-handed direction, the vertical driving surface 57 of the cammed lugs 58 on segment 43 will engage the respective vertical surfaces 55 of clutch element 51 to drive clutch element 51 which, in turn, drives the mandrel 11 in the same direction due to its engagement with square lugs 56. A further discussion of the purpose and operation of clutch 50 is set out below in the detailed operation of tool 10.

Slidably positioned within the bore of body 41 of running tool 40 is a valve sleeve 61 which has a plurality of openings **62*a* therethrough spaced along its length. Valve sleeve 61 is held in a closed position (FIG. 2A, 3A) by upper shear plug 62 and lower shear plug 63. Shear plugs 62 and 63 are hollow so that when the end of the plug is sheared, the passages in which the plugs are threaded are opened to flow as will be explained below. Mounted within sleeve 61 is a ball-catcher 64 which is comprised of a base ring 65 having a plurality of collet-type fingers 66 extending upward therefrom. Base ring 65 is secured in an enlarged-diameter portion of sleeve 61 by a shear pin 67** or the like.

The operation of well tool assembly 10 is as follows. The tool assembly 10 is assembled as shown in FIGS. 2A, 3A, and 4A and is connected to the lower end of a workstring (not shown). As mentioned above, typically a well screen or the like (not shown) will be connected to the lower end of the mandrel 11. The assembly is lowered into the casing 14 of a wellbore. Again, "lowered" is intended to be a relative term since the present assembly is particularly useful in horizontal or inclined wells. As explained above, as long as the workstring is rotated in its normal right-handed direction, clutch 50 will prevent the "left-handed" threads 49 from unthreading and the running tool will remain coupled to the mandrel 11. If all goes well, the assembly is lowered to its operable position in the wellbore where either the liner is grounded on the bottom of the wellbore or is hung from a hanger in the casing.

When the tool reaches its destination, ball 70 (FIG. 3B) is dropped or pumped down the workstring until it engages ball-catcher 64 to block any further downward flow pass that point. Increased pressure will now shear both upper shear plug 62 and lower shear plug 63 and release valve sleeve 61 to move to its open position (FIGS. 2B and 3B). This allows the well fluid being pumped down the workstring to flow effectively above piston 48 (FIG. 2A) and below piston 71 (FIG. 3A). As piston 48 moves down, it forces actuator sleeve 35 downward into engagement with shoulder 72 on outer element 15 of mandrel 11 and into engagement with latch 29. It should also be recognized that sleeve valve 61 can be opened by means of a wireline, if desired.

As recess 73 on actuator sleeve 35 moves adjacent to the upper ends of fingers 33, latch 30 is released to move downward. When detent 31 reaches the reduced diameter 74 on segement 42, it is biased inwardly to release the outer element 15 of mandrel 11 for longitudinal movement with respect to running tool 40. Continued downward movement of piston 48 will move the outer element 15 downward to set both the slips 12 and packer 13 as will understood in the art. The lower wedge 25 will be held against downward movement due to being fixed to the lower part of the mandrel 11 (not shown) and the liner (not shown) being on the bottom of the wellbore or by a liner hanger in the casing. This allows everything above wedge 25 to be moved downward by piston 48, actuator sleeve 35, etc., thereby setting both the slips 12 and the packer 13. Once the work elements are set, they are retained in their position by locking wedge 75 as will be understood in the art.

At the same time as the work elements are being set as described above, well fluid is flowing in below piston 71 through sheared hollow plug 63. As piston 71 moves upwards against clutch element 51, it shears pin 60 and moves clutch element 51 upward to disengage the clutch from both lugs 56 on mandrel 11 and lugs 58 on the running tool. When clutch element 51 is completely disengaged, a detent ring 76 on the clutch element collapses or contracts into recess 77 on body 40 to lock the clutch element in its disengaged position.

Also, after valve sleeve 61 has been moved to its open position and work elements have been set, increased pressure against ball 70 will cause pin 67 to shear which, in turn, allows catcher 64 to move downward where it comes to rest on shoulder 80 on segement 43 of the running tool. In this position, fingers 66 of the catcher 64 can expand outward into the enlarged-diameter 81 of segment 42 whereby ball 70 can pass on through ball-catcher 64 whereupon the passage through the running tool is reopened.

Once clutch 50 has been disengaged, there is no longer a rotational driving connection between the mandrel and the running tool. Accordingly, right-handed or clockwise rotation of the workstring (hence the running tool) will cause left-handed threads 49 to unthread thereby releasing the running tool from the mandrel. The workstring and the running tool is then free to be removed from the wellbore.

Unfortunately, however, there are instances where the well tool assembly may fail to reach its destination and will become stuck in the wellbore. In these instances, it is highly desirable, if not mandatory, to be able to release the running tool from the mandrel so that the running tool and the worksting can be removed from the well. In accordance with the present invention, the clutch 50 provides a way to accomplish this with a minimum of manipulation.

If well tool assembly 10 becomes stuck in the wellbore, the worksting is merely rotated slightly to the left (i.e. counterclockwise). The small amount rotation (approximately three rotations or less) required does not result in any substantial unthreading of the right-handed threaded components in the workstring. Since clutch element 51 is being held against rotation by the square lugs 56 on the stuck mandrel 11, counterclockwise rotation of the workstring will shear pin 60 and will cause the cammed surface 53 on clutch element 51 to ride up on complementary cammed surface 59 on running tool 40.

Approximately, one-quarter turn will move clutch element 51 upward enough to clear the square lugs 56 on the mandrel 11 and continued rotation (2-3 rotations) will cause running tool 40 to move downward relative to the clutch element until detent ring 76 engages recess 77 to thereby lock clutch element 51 in its disengaged position. The workstring is now again rotated in a clockwise or right-handed direction to unthread left-handed threads 49 thereby releasing the running tool 40 from the stuck mandrel 11. This allows the running tool and the associated workstring to be removed from the wellbore.

What is claimed is:

1. A well apparatus comprising:

an elongated cylindrical body coaxially connected to a tubing string for rotation therewith, said body having a longitudinal bore in fluid communication with said tubing string;

a coaxially aligned, tubular member releasably connected to said body for longitudinal motion therewith;

clutch means on said body movable from a first engaged position wherein said clutch is engaged between said body and said tubular member to transfer rotational movement from said body to said tubular member to rotate said tubular member when said tubing string is rotated, to a second disengaged position wherein said clutch is disengaged from said tubular member to allow rotation of said body relative to said tubular member to disconnect said body from said tubular member and allow said tubing string and said elongated body to move longitudinally relative to said tubular member; and means associated with said body for moving said clutch from its first engaged position to its second disengage position.

2. The apparatus of claim 1 wherein said means for moving said clutch means from its first postion engaged to its second disengaged position includes piston means on said body movable from a first position to a second position, said piston means being arranged to move said clutch means from its first engaged position to its second disengaged position when said piston means moves from its first position to its second position.

3. The apparatus of claim 1 wherein said means for moving said clutch means from its first engaged position to its second disengaged position includes cam means on said clutch means which intersect with complementary shaped camming surfaces on said tubular member to cause said clutch means to move from its first engaged position to its second disengaged position when said body is rotated in a first direction, said clutch means and said tubular member having complementary surfaces intersecting said cam means and said cam surfaces which are arranged to transfer rotational movement from said body to said tubular member when said body is rotated in the direction opposite to said first direction while allowing said clutch means to remain in its first engaged position to transfer rotation movement to said tubular member.

4. The apparatus of claim 2 wherein said apparatus includes sleeve means located in said longitudinal bore and moveable from a first closed position blocking fluid communication to said piston means to a second open position to allow fluid from the interior of the tubing string to act against said piston means to move siad piston means fom its first position to its second position.

5. The apparatus of claim 4 wherein said sleeve means is movable by a wireline.

6. The apparatus of claim 4 wherein said sleeve means includes isolating means for closing off said bore of said body to prevent fluid flow from the interior of said tubing string to said tubular member, said isolating means providing means for moving said sleeve means from its first closed position to its second open position in response to pressurized fluid.

7. The apparatus of claim 6 wherein said isolating means includes a cylindrical ball catcher positioned in the bore of said sleeve means, and a ball sealingly retained in said catcher to close off said bore of said body and prevent fluid flow from the interior of said tubing string to said tubular member located below, said ball and said catcher isolating the interior of said tubing string from the interior of said tubular member to allow pressure in the tubing string to act against said ball to move said sleeve means from its first closed position to its second open position.

8. The apparatus of claim 7 wherein said sleeve means includes an annular recess, and wherein said ball catcher is movable to its said second open position under the influence of a higher pressure than required to shift said sleeve means from its first position to its second position in which said ball catcher expands radially into said recess to allow said ball to pass downward through said catcher.

9. The apparatus of claim 4 wherein said apparatus further comprises tool means coaxially attached to said tubular member for longitudinal movement therewith, said tool means having a first running configuration wherein said tool means is in an unset condition and a second set configuration wherein said tool means is in a set condition.

10. The apparatus of claim 9 wherein said sleeve means when in its said second position further communicates pressurized fluid from the interior of said tubing string to manipulate said tool means between said first running configuration to said second set configuration.

11. The apparatus of claim 9 wherein said tool means is a hydraulically set packer and wherein said sleeve means in said second position communicates fluid to manipulate said packer from said first running configuration to said second set configuration.

12. The apparatus of claim 1 wherein said apparatus further comprises tool means coaxially attached to said tubular member for longitudinal movement therewith, said tool means having a first running configuration wherein said tool means is in an unset condition and a second set configuration wherein said tool means is in a set condition.

13. The apparatus of claim 12 wherein said tool means comprises:

a packer manipulable from said unset condition when in said first running configuration to a said set condition when in said second set configuration.

14. The apparatus of claim 1 wherein said apparatus further comprises interconnecting means releasably joining said clutch means to said body to retain said clutch means in said first engaged position, said interconnecting means being releasable at a predetermined force to allow said clutch means to move to said second disengaged position.

15. The apparatus of claim 14 wherein said interconnecting means is a shearable element.

16. The apparatus of claim 1 wherein said tubular member is a mandrel.

17. The apparatus of claim 15 wherein said interconnecting means is a shearable element.

18. A well apparatus comprising:

an elongated cylindrical body extending coaxially from a tubing string and rotatable therewith, said body having a longitudinal bore in fluid communication with said tubing string:

a coaxially aligned tubular member releasably connected with said body;

a cylindrical clutch positioned concentrically around said body and movable longitudinally along said body from a first engaged position wherein said clutch is engaged between said body and said tubular member to transfer rotational movement from said tubing string to said tubular member for rotation therewith, to a second disengaged position wherein said clutch is disengaged from said tubular member to allow rotation of said body relative to said tubular member;

a well tool connected to said tubular member, said well tool having a first running configuration wherein said well tool is in an unset condition and a second set configuration wherein said well tool is in a set condition.

sleeve means slidably positioned in said body and movable from a first closed position to a second open position for communicating fluid from the tubing string to said well tool to manipulate said well tool between said running configuration and said set configuration;

interconnecting means releasably joining said clutch to said body and retaining said clutch in said first engaged position, said interconnecting means being releasable at a predetermined force to allow said clutch to move to said second disengaged position; and means associated with said body for moving said clutch from its said first engaged position to its said second disengaged position.

19. The apparatus of claim 18 wherein said means for moving said clutch from its first engaged position to its disengaged second position includes piston means on said body movable from a first position to a second position, said piston means being arranged to move said clutch from its first engaged position to its second disengaged position when said piston means moves from its first position to its second position.

20. The apparatus of claim 19 wherein said sleeve means in said second position communicates fluid from the interior of the tubing string to said piston means to move said piston means from its first to its second position.

21. The apparatus of claim 18 wherein said sleeve means includes an annular ball catcher positioned in the bore of said sleeve means, and a ball sealingly retained in said catcher to block downward flow through said sleeve means to prevent fluid flow from the interior of said tubing string to said tubular member, said ball and said catcher isolating the interior of said tubing string from the interior of said tubular member to allow pressure in the tubing string to act against said ball and shift said sleeve means from its first position to its second open position, said sleeve means having an annular recess into which said ball catcher shifts and expands radially outward under the influence of a higher pressure than required to shift said sleeve means from its first position to its second position to allow said ball to pass downward through said catcher.

22. The apparatus of claim 18 wherein said tubular member is a mandrel.

23. A method of disconnecting coaxially aligned first and second tubular elements in a wellbore wherein said first element is fluidly connected to a tubing string for rotational movement therewith, said method comprising the steps of:

applying a pressure through said tubing string to move a clutch from a first engaged position at which said clutch normally forms a driving connection between said first and second elements to a second disengaged position to thereby allow relative rotation between said first and second tubular elements; and rotating said first tubular element through the tubing string to disconnect said first tubular element from said second tubular element.

24. A method of disconnecting coaxially aligned first and second tubular elements in a wellbore wherein said first tubular element is connected to a tubing string for rotational movement therewith said method comprising the steps of:

rotating the tubing string in a first direction to cause a first cam surface carried by said first tubular element to engage a second cam surface carried by said second tubular member to provide a driving connection between said first and said second tubular members when said tubing string is rotated in said first direction; and rotating the tubing string in a direction opposite to said first direction to cause said first cam surface to cam against said second cam surface to disconnect said first and second tubular elements.

25. A well assembly comprising:

a mandrel having a well tool connected thereto, said well tool being manipulable from an inoperable position to an operable position within a wellbore;

a setting tool comprising:

an elongated body positioned within said mandrel and connected thereto when said body is rotated relative to said mandrel in a first direction; and releasable means for preventing the disconnecting of said body from said mandrel when said body is rotated in a direction opposite to said first direction with respect to said mandrel; and means for releasing said releasable means whereby said body can be disconnected and removed from said mandrel.

26. The well tool of claim 25 wherein said means for releasing said releasable means comprises:

a clutch positioned between said body and said mandrel and moveable from (a) an engaged position which provides a driving connection between said body and said mandrel when said body is rotated in said first direction and (b) a disengaged position which allows relative movement between said body and said mandrel whereby said body is disconnected from said mandrel when rotated in said opposite direction.

27. The well tool of claim 25 including:

hydraulic means for moving said clutch from said engaged position to said disengaged position.

28. The well assembly of claim 25 wherein said clutch comprises:

a first element connected to said body;

a second element connected to said mandrel, said first and second elements having cooperating cammed surfaces thereon which provide said driving connection therebetween when said body is rotated in said direction opposite to said first direction and cooperating cammed surfaces which will move said clutch to said disengaged position when said body is rotated in said first direction.

29. The well tool of claim 28 including:

hydraulic means for moving said said clutch from said engaged position to said disengaged position.

30. The well tool assembly of claim 26 including:

means for locking said clutch in said disengaged position when said clutch is disengaged.

31. The well tool assembly of claim 29 wherein said mandrel and said body are releasably connected by threads.

32. The well tool assembly of claim 31 wherein said threads are left-handed threads.

* * * * *